US006666642B2

(12) United States Patent
Fourcroy

(10) Patent No.: US 6,666,642 B2
(45) **Date of Patent: *Dec. 23, 2003**

(54) INSTALLATION FOR FILLING A SAND BOX FITTED TO A RAIL VEHICLE

(75) Inventor: Jean-Pierre Fourcroy, Leers (FR)

(73) Assignee: NEU International, Marcq-en-Baroeul (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/082,768

(22) Filed: Feb. 25, 2002

(65) Prior Publication Data

US 2003/0160459 A1 Aug. 28, 2003

(51) Int. Cl.[7] ..... B65F 9/00
(52) U.S. Cl. ..... 414/339; 414/373
(58) Field of Search ..... 414/339, 373

(56) References Cited

U.S. PATENT DOCUMENTS 3,032,079 A * 5/1962 Lisciani ..... 141/95
4,224,968 A * 9/1980 Bosser et al. ..... 141/284
4,552,573 A * 11/1985 Weis et al. ..... 55/312
6,125,199 A * 9/2000 Sato et al. ..... 382/162
6,176,279 B1 * 1/2001 Dahlin et al. ..... 141/231
6,382,272 B1 * 5/2002 Dahlin et al. ..... 141/231
6,419,425 B1 * 7/2002 Fourcroy et al. ..... 406/120

FOREIGN PATENT DOCUMENTS

DE 24 43 552 10/1978
EP 0 561 679 B1 11/1995

* cited by examiner

*Primary Examiner*—Joseph A. Dillon
(74) *Attorney, Agent, or Firm*—Weingarten, Schurgin, Gagnebin & Lebovici LLP

(57) ABSTRACT

An installation for filling a rail vehicle sand box comprises both a pressurized vessel containing sand or other granular material and a portable delivery head connected to the vessel. The installation further comprises an intermediate assembly having a first end fitted with means for airtight coupling to the portable delivery head and a second end connected to the sand box. The intermediate assembly can form part of the equipment of a rail vehicle, or alternatively it can form part of the equipment of a platform.

12 Claims, 4 Drawing Sheets

INSTALLATION FOR FILLING A SAND BOX FITTED TO A RAIL VEHICLE

The present invention relates to an operator delivering a granular material such as sand from a fixed station to fill tanks commonly referred to as "sand boxes" which are provided on rail vehicles, where the term "rail vehicle" covers not only trains but also trams.

BACKGROUND OF THE INVENTION

In rail vehicles, it is known to distribute sand between the wheels and the rail in order to increase adhesion between the wheel and the rail. When the vehicle is starting, and each time that it needs to deliver a large amount of torque, sand is taken from a storage tank referred to as a sand box. The sand box is filled when the vehicle is stationary, in particular when it is standing at a platform. The sand box has an inlet feed orifice which is accessible from outside the vehicle.

In general, sand boxes are filled from a sand storage vessel connected to a feed pipe. The storage vessel is positioned at a height which is sufficient to enable the sand to flow under gravity along the pipe into the inlet orifice of the sand box. In order to increase the flow rate of the sand, the storage vessel can be pressurized.

Proposals have already been made, in particular in documents DE 2 443 552 and EP 0 561 679 for devices to deliver a granular material that comprise both a transfer vessel for the material, which vessel is fed with compressed air under pressure, and a portable delivery head having one end connected by a flexible hose to the transfer vessel. The pressure and flow rate conditions for the compressed air in the transfer vessel are determined in such a manner that the flow of material in the hose corresponds to operation in "dense" phase for DE 2 443 552 and in "solid" phase for document EP 0 561 679.

The devices proposed in those prior documents are suitable for filling sand boxes having inlet orifices at man height, i.e. low enough for an operator standing on the platform to be able to insert the portable head manually into the inlet orifice of the sand box. Such devices are particularly suitable for the European railway network.

In contrast, those devices are not suitable for the North American railway network where rail vehicles are much larger in size with large-capacity sand boxes having their inlet orifices located at the tops of the vehicles so that they are not directly accessible to operators standing on a platform.

OBJECT AND SUMMARY OF THE INVENTION

The object of the present invention is to enable a rail vehicle sand box to be filled when its inlet orifice is not directly accessible to an operator on a platform, with filling taking place via a portable delivery head connected to a pressurized vessel containing sand or other granular materials.

This object is fully achieved by the filler installation of the invention. In conventional manner, the installation comprises at least one pressurized vessel containing sand or other granular material and at least portable delivery head connected to said vessel.

In characteristic manner, said installation further comprises an intermediate assembly having a first end fitted with means for airtight connection to the portable delivery head and whose second end is connected to the sand box.

Thus, an operator on the platform can connect the portable delivery head to the first end of the intermediate assembly, this connection necessarily being airtight, and can then actuate the delivery head to feed sand into the intermediate assembly so that it goes to the inlet orifice of the sand box. The connection between the first end of the intermediate assembly and the delivery head must be airtight because sand is moved from the vessel to the sand box by means of the thrust applied thereto by the compressed air pressurizing the inside of the vessel. Any leakage of air through the connection means would cause the pressure to drop and would thus stop sand displacement from functioning properly.

In a manner that is known from document EP 0 561 679, the portable delivery head comprises both a rigid hollow tube for transferring sand and a suction nozzle which is fixed to the outside of the tube and which is connected to a suction source. Under such circumstances, the intermediate assembly comprises both an intermediate sand transfer pipe and an intermediate air suction pipe, the first ends of said pipes being fitted with means for airtight coupling respectively to the hollow tube and to the suction nozzle of the delivery head, while the second ends of said pipes are connected to the sand box. Below, in the present text, the term "intermediate assembly" without further details covers, as appropriate, either a single intermediate pipe for transferring sand or else two intermediate pipes for transferring sand and for suction, respectively.

In an embodiment, the intermediate assembly is permanently mounted on the rail vehicle. The second end of the intermediate assembly opens out into the top portion of the sand box, either into its inlet orifice or else into a zone that is distinct from the inlet orifice of said sand box. In the second case, it therefore remains possible to fill the sand box in conventional manner under gravity from a storage vessel using the conventional inlet orifice, and also to fill the sand box under manual control of an operator using the portable delivery head and the intermediate assembly that are characteristic of the invention.

The first end of the intermediate assembly opens out laterally through a low portion of the rail vehicle. It can be advantageous to fit the vehicle so as to enable it to be filled regardless of which side of the vehicle is adjacent to the platform. For this purpose, the intermediate assembly includes at least one Y junction whose two upstream ends terminate in two first ends fitted with means for airtight coupling with the delivery head, said ends opening out laterally in respective opposite sides of the rail vehicle.

Some rail vehicles have two independent sand boxes disposed close to each other. Under such circumstances, the intermediate assembly may have at least one Y junction whose two downstream segments terminate in second ends connected to each of the two sand boxes, respectively.

In an embodiment of the filler installation of the invention, the intermediate assembly is permanently mounted on the platform.

Under such circumstances, the installation can include in particular a support gantry and means for fixing the intermediate assembly to the gantry, said gantry comprising a vertical girder fixed to the platform and a top horizontal girder; in addition, in this case, the downstream portion of the intermediate assembly is flexible.

In the first embodiment, all vehicles must be equipped with their own intermediate assemblies. In the second embodiment there is only a single installation and it serves to fill sand boxes via their conventional inlet openings. Nevertheless, this second embodiment presents the drawback whereby the operator must initially open the inlet orifice of the sand box and cause the second end of the intermediate assembly to penetrate therein. This therefore requires additional manual operation which is avoided with the first embodiment of the filler installation.

In a manner disclosed in document EP 0 561 679, the portable delivery head may comprise:

a) a first rigid tube for feeding sand;

b) a removable closure element for shutting the end of the first tube;

c) a shaft for pivoting the closure element, the shaft being mounted along the first tube; and d) a handle for actuating said pivot shaft.

In a manner characteristic of the invention, the delivery head also comprises a support plate having the first tube and the pivot shaft passing therethrough; and the means for airtight coupling comprise means for fixing the support plate to the first end of the intermediate assembly.

Preferably, the first end of the intermediate assembly has a bearing plate which is pierced by an opening to pass the first tube and the removable closure element, the fixing means being suitable for providing releasable and airtight fixing of the support plate to the bearing plate.

When the intermediate assembly includes an intermediate pipe for sucking up dust and the portable delivery head includes a second rigid tube for sucking up dust, then the bearing plate has a second opening for passing the second tube, the first opening being disposed in register with the upstream end of the intermediate pipe for transferring sand, while the second end is placed in register with the upstream end of the intermediate suction pipe.

The fixing means can include, in particular, a gasket which is mounted on one of the two plates, on its face that faces the other plate.

In a particular embodiment, the fixing means may further comprise:

a) a quarter-turn clamping cam mounted free to rotate on the periphery of the support plate; and b) a clamping lever secured to the cam, and the bearing plate may include a peripheral annular shoulder whose inside face is formed with a groove suitable for co-operating with the quarter-turn cam.

Thus, to connect the delivery head with the first end of the intermediate assembly, it suffices for the operator to cause the hollow tube(s) to penetrate into the opening(s) of the bearing plate until the support plate presses against the bearing plate, with the gasket optionally being interposed between said two plates, and then for the operator to actuate the clamping lever so as to cause the cam to turn through quarter of a turn, thereby obtaining airtight coupling between the delivery head and the intermediate assembly.

BRIEF DESCRIPTION OF THE DRAWINGS

The present invention will be better understood on reading the following description of two embodiments of installations for filling sand boxes in a rail vehicle from a portable delivery head for sand, said installation having two intermediate pipes, one for transferring sand and the other for sucking up dust, and as shown in the accompanying drawings, in which.

MORE DETAILED DESCRIPTION

Figure 1:
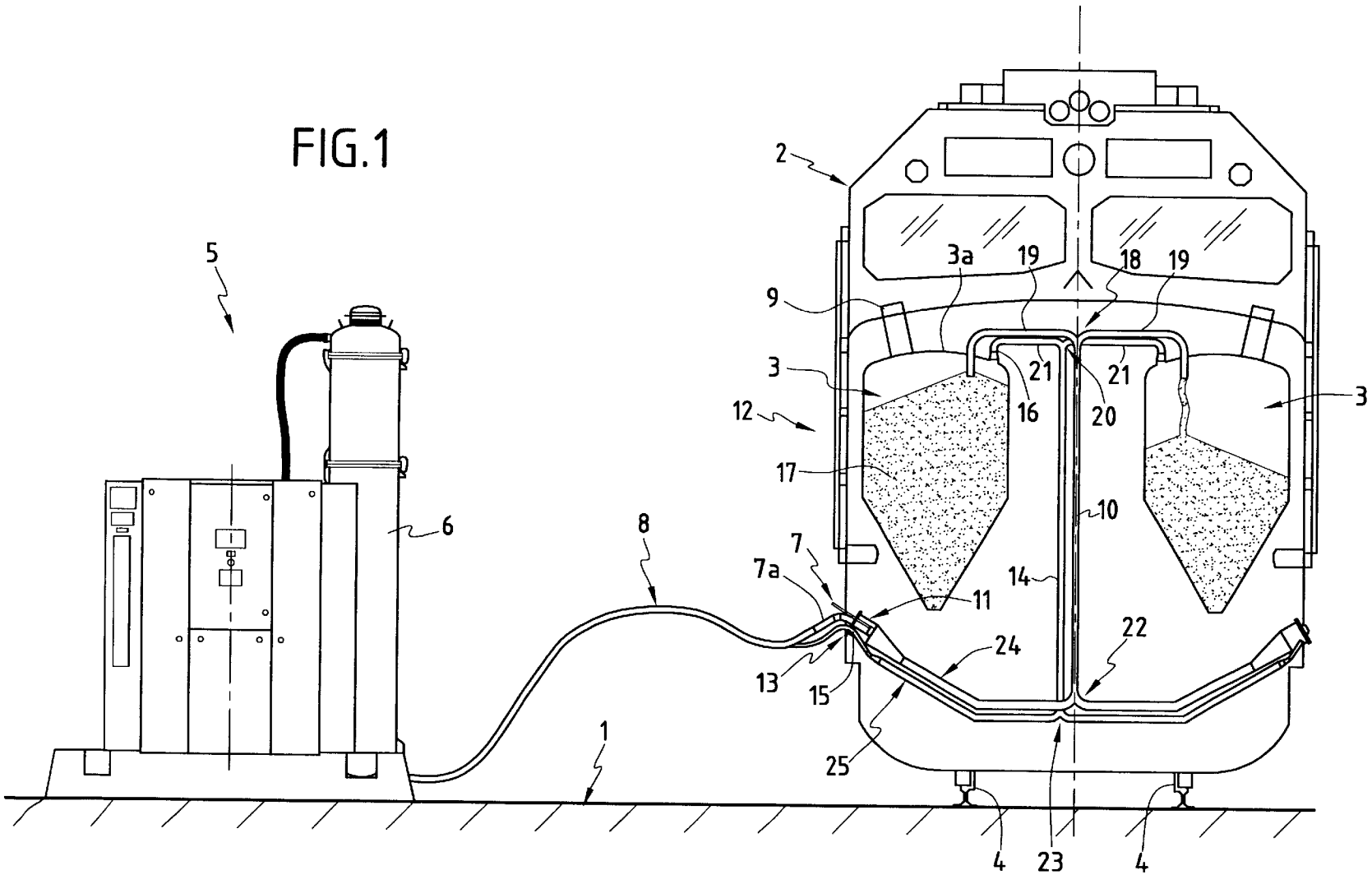
FIG. 1 is a diagrammatic view of a first embodiment in which the intermediate pipes are permanently mounted to a vehicle.
Figure 2:
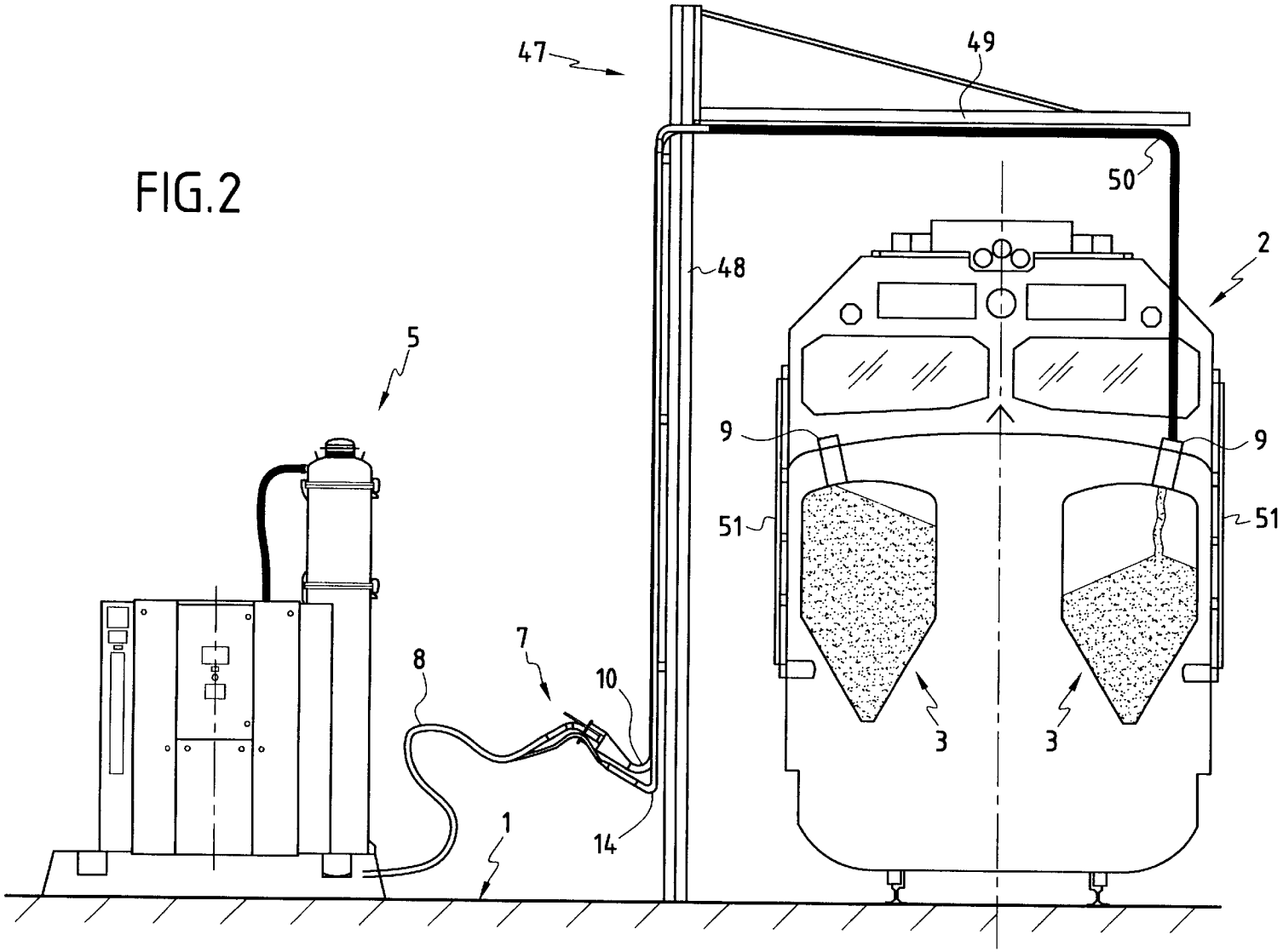
FIG. 2 is a diagram showing a second embodiment in which the intermediate pipes are permanently mounted to a platform.

FIGS. 1 and 2 are diagrams showing a platform 1 with a rail vehicle 2 standing next to it, in this case a locomotive or a motor power unit, which is to have its two sand boxes 3 filled. For simplification purposes, the rails 4 on which the vehicle 2 is standing are shown as being as in the same plane as the platform 1, but they could equally well be situated in a plane that is at a different height from the platform 1.

A fixed station 5 for delivering sand is shown on the platform 1. This station 5 comprises a transfer vessel 6 which is fed with compressed air under pressure and a portable delivery head 7 whose rear end 7*a* is connected by a flexible pipe 8 to the transfer vessel 6. This station is as taught in document EP 0 561 679. Thus, in conventional manner that is not shown, a sand storage silo feeds a plurality of storage vessels disposed beneath the level of the platform 1, each storage vessel itself being connected to and feeding a plurality of transfer vessels such as the vessel 6 that is shown.

In a manner that is traditional for rail vehicles on the North American continent, each of the sand boxes 3 is of large capacity so that its inlet orifice 9 which is situated at the top of said sand box 3 must necessarily open to the outside of the vehicle 2 at a height which is much higher than the height of a man standing on the platform 1. The invention makes it possible for an operator on the platform to fill the sand box 3 using the portable head 7 of the sand delivery station 5 by implementing at least one intermediate sand transfer pipe having a first end which includes means for airtight connection to the delivery head 7 and a second end which is connected to the inlet opening of the sand box 3.

In the first embodiment as shown in FIG. 1, the sand transfer pipe 10 is permanently mounted to the rail vehicle 2. Its first end 11 opens out to one of the sides 12 of the vehicle 2 at a height h above the plane of the platform 1 which makes it easily accessible to an operator on the platform that has the portable delivery head 7.

The second end 12 thereof opens out into the top portion 3*a* of a sand box 3.

In the example shown, the portable head 7 is provided with a suction tube 13, and the intermediate sand transfer pipe 10 is accompanied by an intermediate suction pipe 14. The first end 15 of the intermediate suction pipe 14 likewise opens out to one side of the vehicle, in the immediate vicinity of the first end 11 of the intermediate pipe 10 for transferring sand, while its second end 16 opens out into the top portion 3*a* of the sand box 3, likewise close to the second end 12 of the intermediate sand transfer pipe 10.

The portable head 7 must be capable of being connected in airtight manner to the two ends 11 and 15 of the two intermediate pipes 10 and 14, respectively. The displacement of sand 17 from the transfer vessel 5 to the sand box 3 is obtained by means of the high pressure which exists inside the transfer vessel 6. In particular, the pressure and flow rate conditions for compressed air in the transfer vessel 6 are determined in such a manner that the flow of sand along the flexible pipe 8, into the portable head 7, and then along the intermediate pipe 10 corresponds to operation in "solid" phase. Nevertheless, this is not essential, and conditions can be designed so that flow takes place in "dense" phase, as in document DE 2 443 552, for example.

The disposition of the intermediate pipes 10 and 14 must naturally take account of the space available that exists inside the portion of the vehicle 2 containing the sand box(es) 3. In the example shown in FIG. 1, both sand boxes are filled simultaneously from the same first end 11 of the intermediate sand transfer pipe 10. To do this, the intermediate pipe 10 has a Y junction 18 whose two downstream segments 19 act as respective second ends of the intermediate pipe 10 and open out into the two sand boxes 3, respectively. The same applies to the intermediate suction pipe 14 which likewise has a Y junction 20 whose two downstream segments 21 act as second ends for said pipe 14 and open out into the upper portions 3*a* of the two sand boxes 3 respectively.

In this same example as shown, both sand boxes 3 can be filled regardless of which side of the vehicle 2 is adjacent to the delivery station 5 on the platform 1. To make this possible, both intermediate pipes 10 and 14 have two other respective Y junctions 22 and 23 whose respective upstream segments 24 and 25 act as first ends 11 and 15 for said two intermediate pipes 10 and 14.

Airtight coupling between the portable head 7 and the first ends 11, 15 of the intermediate pipes 10, 14 is described below with reference to FIGS. 3 and 4.

Figure 3:
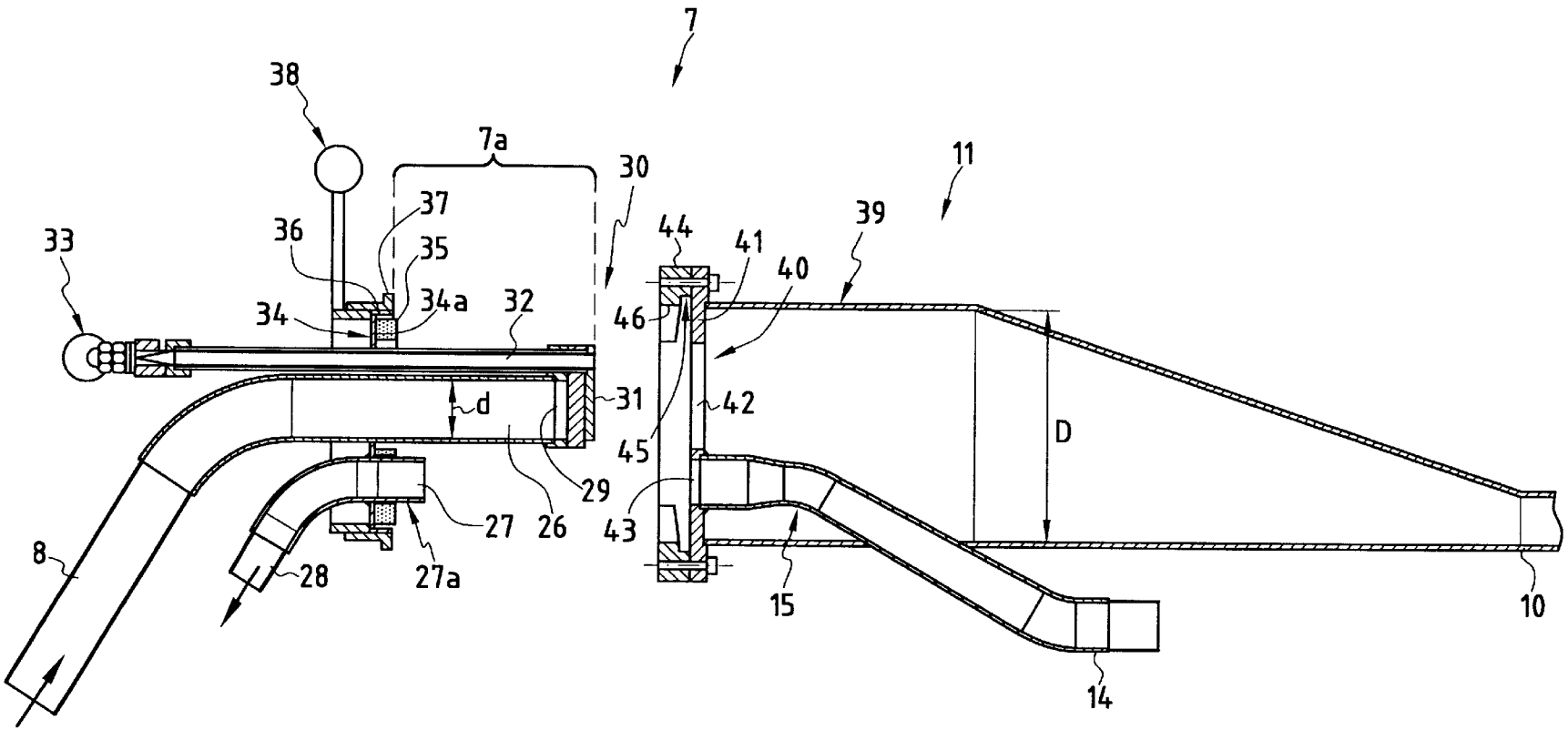
FIGS. 3 and 4 are diagrammatic longitudinal sections of the delivery head and of the first ends of the two intermediate pipes, shown firstly prior to being coupled together (FIG. 3) and secondly once coupling has been achieved (FIG. 4).
Figure 4:
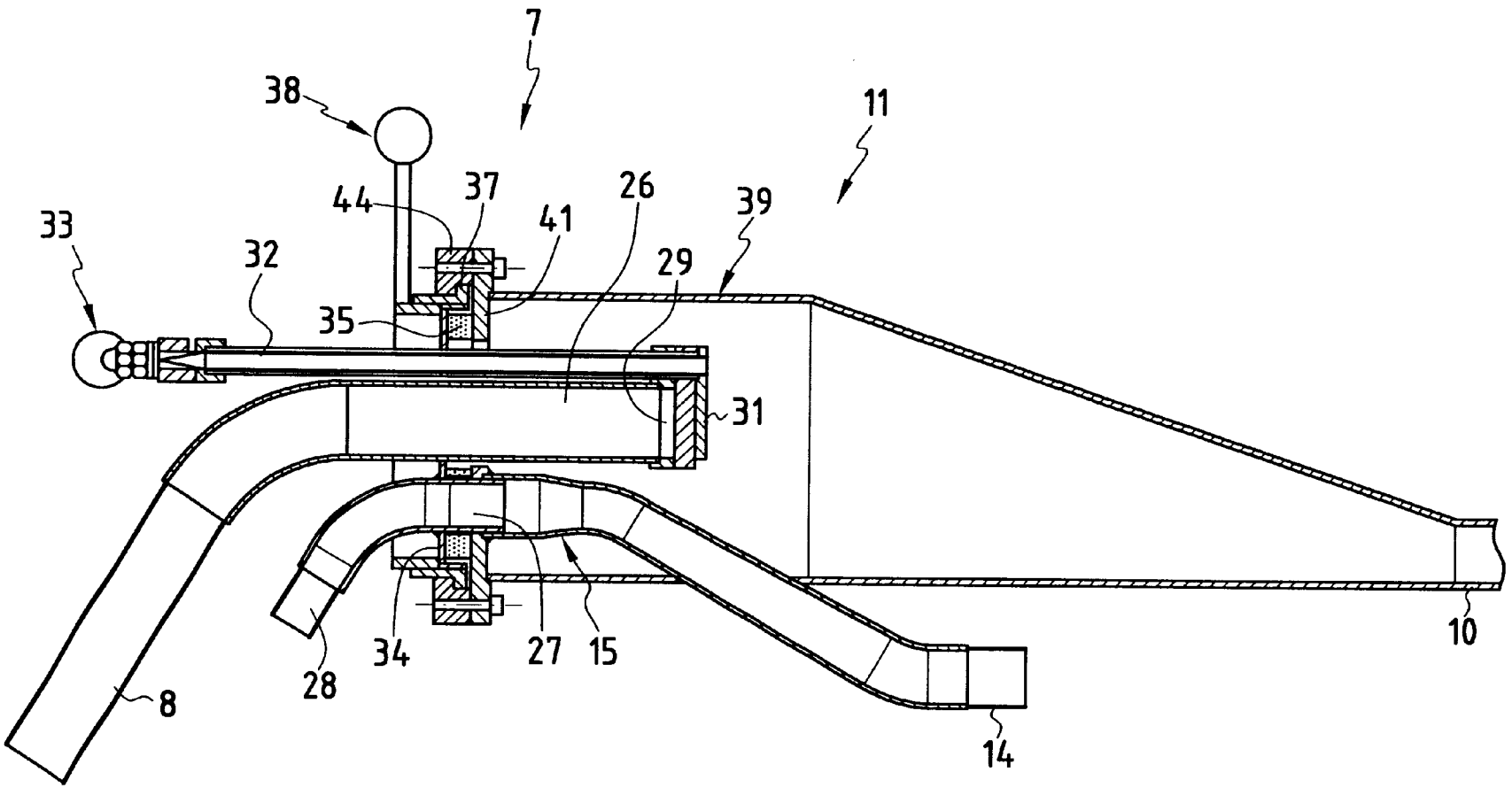

FIG. 3 shows the portable head 7 prior to being inserted into the first end 11 of the intermediate sand transfer pipe 10. For simplification purposes, in FIG. 3, this first end 11 is shown extending substantially horizontally whereas it is, in fact, oblique once fitted to the rail vehicle 2, as can be seen in FIG. 1.

The portable sand delivery head 7 has a first rigid hollow tube 26 whose rear end 26*a* is connected to the flexible hose 8 which is itself connected to the transfer vessel 6 of the filler station 5. The portable head 7 also has a second rigid hollow tube 27 which is connected via a sheath 28 to a suction source.

The outlet orifice 29 of the first hollow tube 26 is provided with a removable shutter 30 which consists in a shutter plate 31 facing said outlet orifice 29 in the closed position. This shutter plate 31 is mounted to pivot with a rod 32 which extends longitudinally along the outside of the first hollow tube 26 which is fixed to the shutter plate 31 in an eccentric portion thereof. This rod 32 can be turned angularly by a handle 33 which is situated opposite from the shutter plate 31 and which is accessible to the operator.

Around the two hollow tubes 26 and 27 and the actuator rod 32, there is mounted transversely a support plate 34 so that said plate, e.g. of generally circular shape, surrounds both tubes and the rod in leaktight manner. On the front face 34*a* of the support plate 34 there is fixed a gasket 35 which is pierced by the two tubes 26 and 27 and by the rod 32.

The support plate 34 has a peripheral annular shoulder 36 with a quarter-turn clamping cam 37 mounted free to rotate on the outside thereof, which cam can be actuated by a clamping lever 38.

The first end 11 of the intermediate sand transfer pipe 10 is terminated by a funnel box 39 into which the second end 15 of the intermediate suction pipe 14 penetrates, as can be seen on the right-hand side of FIG. 3. The circular funnel box 39 has a diameter D which is greater than the normal diameter d of the intermediate transfer pipe 10, said diameter d being equal to the diameter d of the first hollow tube 26 of the delivery head 7.

Beyond the funnel box 39, the diameter of the intermediate pipe 10 tapers progressively like a funnel down to the normal diameter d.

On the peripheral edge of the inlet orifice 40 of the funnel box 39 there is mounted transversely a bearing plate 41 which is pierced by two through openings 42 and 43. These two through openings 42 and 43 are shaped in such a manner as to allow the leading portion 7*a* of the delivery head 7 to pass through, i.e. the portion extending from the shutter plate 31 to the gasket 39 and not including said gasket. More precisely, the first through opening 42 receives the first tube 26 in the funnel box 39 together with the actuator rod 32 and the shutter plate 31 in its closed position.

The first end 15 of the intermediate suction pipe 14 is connected inside the box 39 to the second through opening 43. Said second opening 43 is shaped to receive as a close-fit the leading portion 27*a* of the second tube 27, i.e. the portion thereof which projects beyond the gasket 35.

The front of the bearing plate 41 carries an annular shoulder 44 which includes a groove 45 formed in its inside face 46. This groove 45 is designed to receive the quarter-turn cam 37.

To connect the delivery head 7 in airtight manner to the first ends 11 and 15 of the two intermediate pipes 10 and 14, it suffices for the operator to insert the leading portion 7*a* of said head 7 through the two through openings 42 and 43, taking care that the cam 37 penetrates into the longitudinal portion of the groove 45, and until the gasket 35 comes to bear against the front face of the bearing plate 41. In this position, the operator actuates the lever 38 so as to turn the cam 37 to make it travel along the annular and slightly helical portion of the groove 45 so as to cause the support plate 36 and the bearing plate 41 to move towards each other, thereby compressing the gasket 35. This relative position of the various members provides airtight coupling and is shown in FIG. 4.

Once airtight coupling has been achieved, the operator can open the shutter plate 31 of the outlet orifice 29 of the head 7 by actuating the handle 33. This pivoting of the shutter plate 31 is made possible because of the large dimensions of the box 39 in which the shutter plate 31 is then located.

Sand can then escape from the delivery head 7 by passing through the outlet orifice 29 of the first tube 26 and penetrating into the box 39, after which it moves along the intermediate sand transfer pipe 10 until it reaches the sand box 3.

For its part, the intermediate suction pipe 14 which is connected in airtight manner to the second tube 27 of the delivery head 7 enables dust to be sucked up, likewise from the sand box 3.

Once the sand box 3 has been filled, the operator uses the handle 33 to close the first tube 26 of the sand delivery head 7, and then actuates the lever 38 to release the cam 37. The head 7 can then be withdrawn from the first ends 11, 15 of the intermediate pipes 10, 14. Sand remains in the intermediate pipe 10, which sand will remain there until the sand box 3 is next filled. Nevertheless, this sand which remains between two successive fills has a tendency to become compact because of the movements of the vehicle. Such compacted sand could form a plug preventing sand from being transferred along the intermediate pipe 10 on the next fill. To avoid this drawback, prior to inserting sand from the head 7 into the first end 11, it is recommended to blow in a certain quantity of compressed air. This blast of compressed air serves to decompact the sand present in the intermediate pipe 10 and to put the sand back into conditions favorable for being moved along the intermediate pipe 10, in particular when operating in "solid" phase or "dense" phase. This blast can be obtained from a compressed air feed nozzle included in the delivery head 7.

In the second embodiment as shown in FIG. 2, the two intermediate sand transfer and suction pipes are permanently mounted to the platform 1 by means of a supporting gantry 47 comprising a vertical girder 48 fixed to the platform and a top horizontal girder 49 situated at a height H which is high enough to be above the rail vehicle 2. The two first ends 11, 15 of the two intermediate pipes 10, 14 are fixed to the vertical gantry 48 near to the bottom thereof so that they are easily accessible to an operator carrying the portable sand delivery head 7.

The two intermediate pipes 10, 14 are fixed by any suitable means to the gantry 47.

In this embodiment, the sand boxes 3 are filled using the conventional inlet orifices 9 thereof. The operator must therefore cause the rear ends of said intermediate pipes to penetrate into said orifice 9 regardless of the position of the vehicle 2 relative to the gantry 47. To do this, the downstream portion 50 of said intermediate pipes 10, 14 is flexible so as to be easily displaced by an operator climbing up a ladder 51 which is provided on the side face of the vehicle 2.

To enable both sand boxes 3 to be filled, it is preferable for the horizontal top girder 49 to be mounted to pivot relative to the vertical girder 48 so that the operator can bring the extreme downstream portion of the two pipes 10, 14 over the inlet orifice 9 of the particular sand box 3 that is to be filled.

What is claimed is:

1. An installation for filling a rail vehicle sand box, the installation comprising at least one pressurized vessel containing granular material and at least one portable delivery head connected to said vessel, the installation further comprising an intermediate assembly having a first end fitted with means for airtight coupling to the portable delivery head and a second end connected to the sand box.

2. The installation according to claim 1, wherein the portable delivery head comprises a hollow rigid tube for transferring the granular material and a suction nozzle which is fixed to the outside of the tube and connected to a suction source, and wherein the intermediate assembly comprises an intermediate sand transfer pipe and an intermediate air suction pipe having a first end fitted with means for airtight coupling to the suction nozzle of the delivery head and a second end connected to the sand box.

3. The installation according to claim 1, wherein the intermediate assembly is permanently mounted on the rail vehicle.

4. The installation according to claim 3, wherein the second end of the intermediate assembly opens out into the top portion of the sand box in a zone that is different from the inlet orifice of said sand box.

5. The installation according to claim 3, wherein the intermediate assembly includes at least one Y junction whose two upstream segments are terminated by two first ends fitted with means for airtight coupling to the delivery head and opening out on respective sides of the rail vehicle.

6. The installation according to claim 3, wherein the rail vehicle has two independent sand boxes disposed close to each other, and wherein the intermediate assembly has at least one Y junction whose two downstream segments are terminated by second ends connected respectively to each of the two sand boxes.

7. The installation according to claim 1, wherein the intermediate assembly is permanently mounted to the platform.

8. The installation according to claim 7, including a support gantry and means for fixing the intermediate assembly to the gantry, said gantry comprising a vertical girder fixed to the platform and a horizontal top girder, the downstream portion of the intermediate assembly being flexible.

9. The installation according to claim 1, wherein the portable delivery head comprises:

a) a first rigid tube for feeding the granular material;

b) a removable closure element for shutting the end of the first tube;

c) a shaft for pivoting the closure element, the shaft being mounted along the first tube; and d) a handle for actuating said pivot shaft, wherein the delivery head includes a support plate having the first tube and the pivot shaft passing therethrough, and wherein the means for airtight coupling comprises means for fixing the support plate to the first end of the intermediate assembly.

10. The installation according to claim 9, wherein the intermediate assembly comprises an intermediate sand transport pipe and an intermediate dust suction pipe, wherein the portable delivery head includes a second rigid tube for sucking up dust, and wherein the bearing plate includes a second opening for passing the second tube, the first opening being placed in registration with the upstream end of the intermediate sand transfer pipe while the second opening is placed in registration with the upstream end of the intermediate suction pipe.

11. The installation according to claim 9, wherein the fixing means includes a gasket which is mounted on one of two plates, on its face facing the other plate.

12. The installation according to claim 9, wherein the fixing means further includes:

a) a quarter-turn clamping cam mounted free to rotate on the periphery of the support plate; and b) a clamping lever secured to the cam, and wherein the bearing plate includes a peripheral annular shoulder whose inside face is formed with a groove suitable for co-operating with the quarter-turn cam.

* * * * *